US012022866B2

(12) United States Patent
Yuan et al.

(10) Patent No.: US 12,022,866 B2
(45) Date of Patent: Jul. 2, 2024

(54) ATOMIZER AND ELECTRONIC CIGARETTE

(71) Applicant: SHENZHEN FIRST UNION TECHNOLOGY CO., LTD., Shenzhen (CN)

(72) Inventors: Jun Yuan, Shenzhen (CN); Baoling Lei, Shenzhen (CN); Qigen Wang, Shenzhen (CN); Wen Shi, Shenzhen (CN); Zhongli Xu, Shenzhen (CN); Yonghai Li, Shenzhen (CN)

(73) Assignee: SHENZHEN FIRST UNION TECHNOLOGY CO., LTD., Shenzhen (CN)

( * ) Notice: Subject to any disclaimer, the term of this patent is extended or adjusted under 35 U.S.C. 154(b) by 397 days.

(21) Appl. No.: 17/597,689

(22) PCT Filed: Jul. 29, 2020

(86) PCT No.: PCT/CN2020/105579
§ 371 (c)(1),
(2) Date: Jan. 18, 2022

(87) PCT Pub. No.: WO2021/018215
PCT Pub. Date: Feb. 4, 2021

(65) Prior Publication Data

US 2022/0240572 A1 Aug. 4, 2022

(30) Foreign Application Priority Data

Jul. 30, 2019 (CN) ..... 201921237758.1

(51) Int. Cl.
*A24F 40/10* (2020.01)
*A24F 40/40* (2020.01)

(52) U.S. Cl.
CPC ..... *A24F 40/10* (2020.01); *A24F 40/40* (2020.01)

(58) Field of Classification Search
CPC ..... A24F 40/10; A24F 40/40; A24F 40/44; A24F 40/42
See application file for complete search history.

(56) References Cited

U.S. PATENT DOCUMENTS 10,111,464 B1 * 10/2018 Balder ..... A24F 1/32
2017/0295845 A1 * 10/2017 Bajpai ..... A61M 11/042
(Continued)

FOREIGN PATENT DOCUMENTS

CN 105747278 A 7/2016
CN 109007980 A 12/2018
(Continued)

*Primary Examiner* — Truc T Nguyen
(74) *Attorney, Agent, or Firm* — Proi Intellectual Property US; Klaus Michael Schmid

(57) ABSTRACT

An atomizer and an electronic cigarette are provided. The atomizer comprises an outer housing, and an e-liquid storage chamber and an atomization assembly are disposed in the outer housing. The atomization assembly comprises a porous element and a heating element. The porous element comprises an e-liquid absorbing surface. A bubble guiding element opposite to the e-liquid absorbing surface is further provided in the outer housing, and comprises a bubble guiding surface opposite to the e-liquid absorbing surface. At least a portion of the bubble guiding surface is obliquely configured in a direction facing away from the e-liquid absorbing surface, such that bubbles emerging from the e-liquid absorbing surface of the porous element are guided toward the direction facing away from the e-liquid absorbing surface.

20 Claims, 6 Drawing Sheets

(56) References Cited

U.S. PATENT DOCUMENTS

| | | | | |
|---|---|---|---|---|
| 2018/0035721 | A1* | 2/2018 | Cyphert | A61M 11/003 |
| 2018/0289065 | A1 | 10/2018 | Liao et al. | |
| 2019/0124975 | A1 | 5/2019 | Cyphert et al. | |
| 2019/0166906 | A1* | 6/2019 | Balder | A24F 1/32 |
| 2020/0008473 | A1* | 1/2020 | Schmidt | A61M 15/06 |
| 2022/0338543 | A1* | 10/2022 | Shi | H05B 3/46 |
| 2023/0210182 | A1* | 7/2023 | Zhao | A24F 40/44 131/329 |

FOREIGN PATENT DOCUMENTS

| | | | |
|---|---|---|---|
| CN | 109452691 | A | 3/2019 |
| CN | 209106324 | U | 7/2019 |
| CN | 210782908 | U | 6/2020 |

* cited by examiner

ATOMIZER AND ELECTRONIC CIGARETTE

CROSS REFERENCE TO RELATED APPLICATION(S)

This application claims priority to Chinese Patent Application entitled "Atomizer and electronic cigarette" with application number of 201921237758.1, submitted to China National Intellectual Property Administration on Jul. 30, 2019, the entire contents of which are incorporated herein by reference.

TECHNICAL FIELD

The present disclosure relates to the field of electronic cigarettes, and in particular to an atomizer and an electronic cigarette.

BACKGROUND

Tobacco products (e.g., cigarettes, cigars, etc.) are burning tobaccos to produce tobacco smoke during use. People attempt to make products that release compounds without burning so as to replace the tobacco products burning tobaccos.

An example of this type of product is a heating device, which heats rather than burns a material to release compounds, for example, the material may be a tobacco product or other non-tobacco products which may contain or not contain nicotine. As an example, there is an aerosol supplying product, for example, the so called electronic cigarette device. These devices generally contain an e-liquid, which is heated and atomized to generate an inhalable vapor or aerosol. The e-liquid may contain nicotine and/or aromatics and/or aerosol generating substances (for example, glycerol).

Known electronic cigarette devices generally include a porous ceramic element having a large number of micropores, which is configured for absorbing and transferring the e-liquid; further, a heating element is arranged on one surface of the porous ceramic element to heat and atomize the absorbed e-liquid. The micropores inside the porous element on one hand act as a channel through which the e-liquid soaks and flows onto the atomizing surface, and on the other hand act as an air exchange channel through which air is supplied to the liquid storage chamber from the outside to maintain the air pressure inside the liquid storage chamber when the e-liquid inside the liquid storage chamber is consumed, such that bubbles are generated inside the porous ceramic element when the e-liquid is consumed through heating and atomization, and then the bubbles emerge from the e-liquid absorbing surface to enter the liquid storage chamber. In order for the porous ceramic element to be installed and fixed inside the atomizer, as an existing technology, the porous ceramic element generally is assembled inside an accommodation support, meanwhile an e-liquid guiding channel is defined on the accommodation support to transfer the e-liquid to the e-liquid absorbing surface of the porous ceramic element; however, lots of bubbles generated during atomization will gather at the e-liquid guiding channel communicated with the e-liquid absorbing surface after emerging from the e-liquid absorbing surface, thereby affecting the absorption of e-liquid of the e-liquid absorbing surface.

SUMMARY

In order to solve the problem in existing technologies that the atomizer does not supply an e-liquid smoothly, the embodiment of the present disclosure provides an atomizer that can supply an e-liquid smoothly.

Based on the above aim, the atomizer of the present disclosure includes an outer housing, wherein an airflow channel, an e-liquid storage chamber configured for storing an e-liquid and an atomization assembly configured for atomizing the e-liquid are arranged inside the outer housing; the atomization assembly includes a porous element configured for absorbing the e-liquid from the e-liquid storage chamber, and a heating element configured for heating and atomizing the e-liquid absorbed by the porous element to generate an aerosol; the porous element includes an e-liquid absorbing surface configured for absorbing the e-liquid from the e-liquid storage chamber, and an air inlet surface different from the e-liquid absorbing surface, wherein the air inlet surface is incorporated inside the airflow channel and is configured for allowing air to enter the porous element such that bubbles escape from the liquid absorbing surface to the liquid storage chamber; wherein a bubble guiding element opposite to the e-liquid absorbing surface is further arranged inside the outer housing and includes a bubble guiding surface opposite to the e-liquid absorbing surface, at least a portion of the bubble guiding surface is obliquely arranged in a direction away from the e-liquid absorbing surface, such that the bubbles escaping from the e-liquid absorbing surface are guided towards the direction away from the e-liquid absorbing surface.

Preferably, the porous element partially extends to the e-liquid storage chamber such that the e-liquid absorbing surface is located inside the e-liquid storage chamber.

Preferably, at least a portion of a projection of the bubble guiding surface along the axial direction of the outer housing covers the e-liquid absorbing surface of the heating element.

Preferably, the bubble guiding surface and the e-liquid absorbing surface are spaced with certain distance, to form an area opposite to the e-liquid absorbing surface and supplying the e-liquid to the e-liquid absorbing surface.

Preferably, a shortest distance between the bubble guiding surface and the e-liquid absorbing surface along the axial direction of the outer housing is greater than 3 mm.

Preferably, the sealing base is arranged extending along a cross section of the outer housing;

the support portion includes a first support portion and a second support portion that are arranged on two sides of the sealing base along the cross section of the outer housing; and between the first support portion and the second support portion is formed a channel for the e-liquid to flow to the area from the e-liquid storage chamber.

Preferably, at least a portion of the airflow channel runs through the support portion along the axial direction of the outer housing.

Preferably, at least a portion of the airflow channel has a cross-section area decreased gradually along the flow direction of airflow.

Preferably, the sealing base defines a through accommodation chamber along the axial direction of the outer housing, and the porous element is accommodated inside the accommodation chamber.

The present disclosure further provides an electronic cigarette, including an atomization device configured for atomizing an e-liquid to generate an aerosol, and a power device configured for supplying power to the atomization device, wherein the atomization device includes the atomizer described above.

The above atomizer in the present disclosure uses the bubble guiding element to quickly guide the bubbles emerging from the e-liquid absorbing surface away from the e-liquid absorbing surface, such that the bubbles can be prevented from accumulating near the e-liquid absorbing surface and thus affecting the absorption of e-liquid.

BRIEF DESCRIPTION OF THE DRAWINGS

One or more embodiments are illustrated through the image(s) in corresponding drawing(s). These illustrations do not form restrictions to the embodiments. Elements in the drawings with a same reference number are expressed as similar elements, and the images in the drawings do not form restrictions unless otherwise stated.

DETAILED DESCRIPTION

For a better understanding of the present disclosure, the present disclosure is described below in further detail in conjunction with accompanying drawings and specific embodiments.

One embodiment of the present disclosure provides an atomizer, wherein the atomizer heats and atomizes an e-liquid to generate an inhalable aerosol. Based on the purpose of smooth transmission of e-liquid during the e-liquid atomization process, FIG. 1 to FIG. 5 show a structure of an atomizer according to one embodiment.

Referring to FIG. 1 to FIG. 5, the atomizer includes:

a hollow cylindrical outer housing 10, which includes a proximal end 110 and a distal end 120 opposite one another along an axial direction, wherein, in accordance with the requirements of common usage, the proximal end 110 is configured as one end for mounting a mouthpiece and inhaling the aerosol, and the distal end 120 is configured as one end for assembling and connecting an atomizer with a power part of the electronic cigarette.

Based on differences from the above usage, the proximal end 110 of the outer housing 10 defines a smoking port A, for a user to smoke; the distal end 120 of the outer housing 10 is of an opening design, on which a detachable end cover 20 is mounted; the opening structure of the distal end 120 is configured for mounting each necessary functional element of the atomizer into the outer housing 10.

Figure 1:
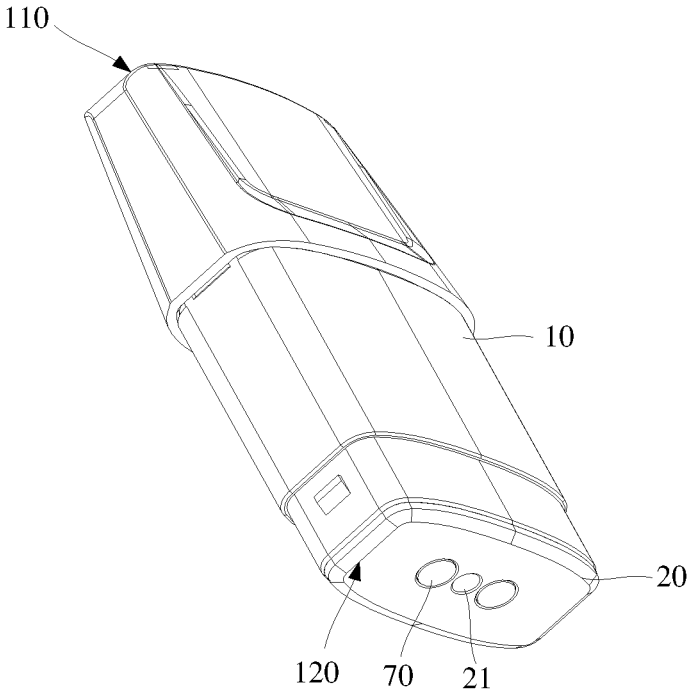
FIG. 1 is a structure diagram of an atomizer according to one embodiment.
Figure 2:
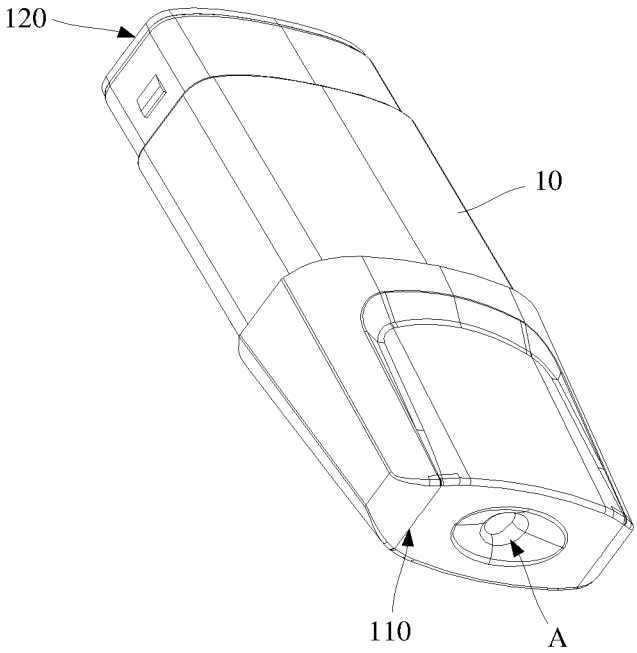
FIG. 2 is a structure diagram of the atomizer shown in FIG. 1 from another perspective.
Figure 3:
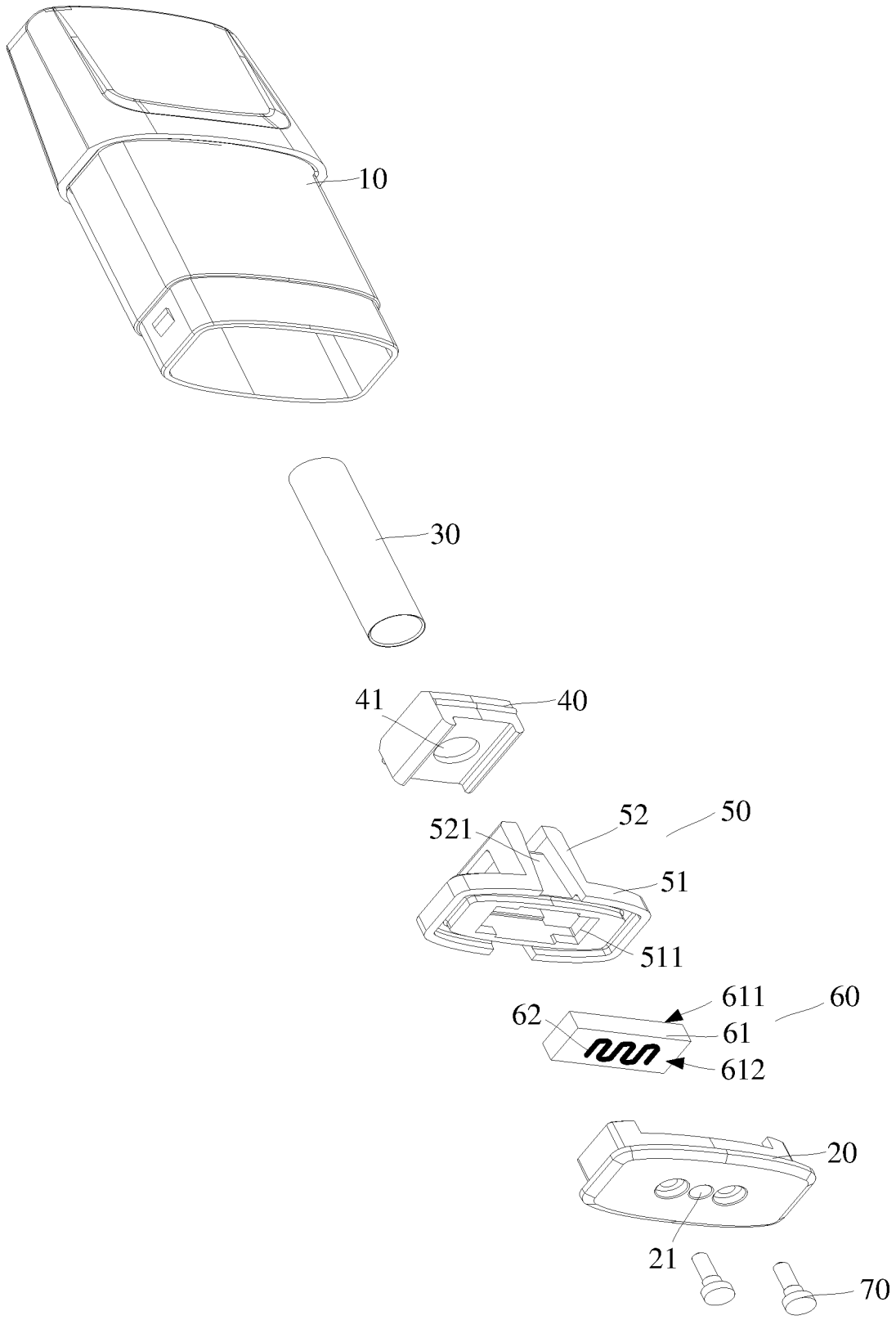
FIG. 3 is a decomposition view of the atomizer shown in FIG. 1.

In the decomposition view of each part shown in FIG. 3, a space inside the outer housing 10 forms an e-liquid storage chamber 11 configured for storing an e-liquid, and a smoke transmission pipe 30 is arranged inside the e-liquid storage chamber 11 along the axial direction, wherein a first end of the smoke transmission pipe 30 opposite to the proximal end 100 is communicated with the smoke port A, and a second end opposite to the distal end 120 is connected to a silicone connection element 40, so as to transmit the aerosol generated by atomizing the e-liquid inside the atomizer to the smoke port A to be inhaled.

Figure 4:
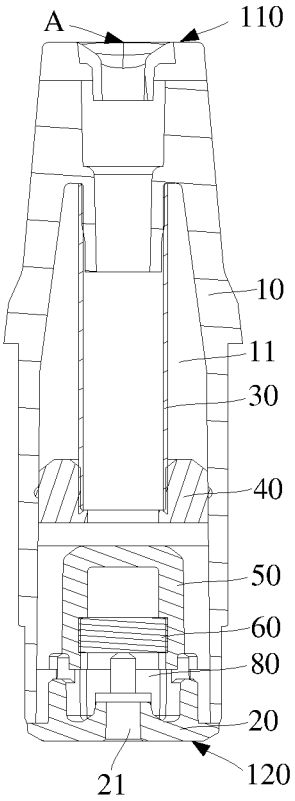
FIG. 4 is a sectional view of the atomizer shown in FIG. 1 from one perspective.
Figure 5:
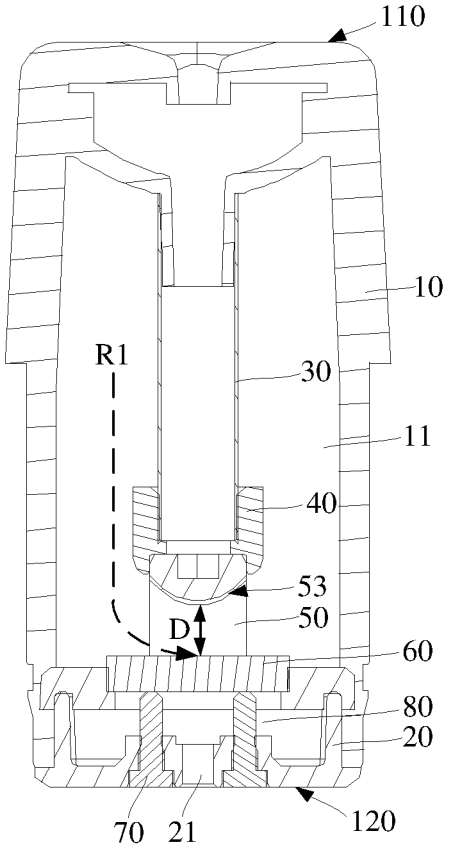
FIG. 5 is a sectional view of the atomizer shown in FIG. 1 from another perspective.

Further, referring to FIG. 3 to FIG. 5, inside the outer housing 10 is arranged an atomization assembly 60 configured for absorbing an e-liquid from the e-liquid storage chamber 11 and heating and atomizing the e-liquid, wherein the atomization assembly 6 includes a porous element 61 configured for absorbing the e-liquid from the e-liquid storage chamber 11, and a heating element 62 configured for heating and atomizing the e-liquid absorbed into the porous element 61. As shown in FIG. 3, the porous element 61 in the present embodiment roughly presents, but not limited to, a block shaped structure; according to the usage, the porous element 61 includes an e-liquid absorbing surface 611 and an air inlet surface 612 opposite one another along the axial direction of the outer housing 10, that is, the upper and lower surfaces of the block shaped porous element 61 shown in FIG. 3. The e-liquid absorbing surface 611 is located inside the e-liquid storage chamber 11 and directly contacts the e-liquid inside the e-liquid storage chamber 11, so as to absorb the e-liquid; the direction of the e-liquid flowing onto the e-liquid absorbing surface 611 to be absorbed is as indicated by an arrow R1 shown in FIG. 5; micropores inside the porous element 61 then transfer the e-liquid to the air inlet surface 612 to be heated and atomized into an aerosol, which is released and escapes from the air inlet surface 612. In the structure of the porous element 61 shown in FIG. 3, since the e-liquid absorbing surface 611 is parallel to the air inlet surface 612, the aerosol and the e-liquid move more smoothly inside the porous element 61, and the porous element 61 is convenient to manufacture.

In some embodiments, the porous element 61 may be made of rigid capillary structures such as porous ceramic, porous glass-ceramic and porous glass. The heating element 62 preferably selects a mixed slurry of conductive raw material powder and printing agents, which is then printed and sintered onto the air inlet surface 612 according to an appropriate pattern, such that all or most of the surface is tightly combined with the air inlet surface 612. Thus, the heating element achieves effects such as high efficiency of atomization, low loss of heat, dry burning resistance or great reduction of drying burning. In some embodiments, the heating element 62 may employ multiple forms of structures. The heating element 62 may be a sheet like heating element formed in certain pattern combined with the air inlet surface 612, or a heating net, a disc like heating element formed spirally by a heating wire, a heating film, and other forms. For example, the particular pattern may be a snake like sinuous shape. In some embodiments, the heating element 62 may select stainless steel, nickel chromium alloy, iron chromium aluminum alloy, metal titanium and other materials.

As shown in embodiments of FIG. 3 to FIG. 5, the air inlet surface 612 is opposite to the end cover 20, and they are spaced with certain distance to form an atomization chamber 80. On one hand, the end cover 20 is provided with two electrode columns 70 that are in electrical connection with the heating element 62 on the air inlet surface 612 of the porous element 61; as shown in FIG. 5, the electrode columns 70, after installed, press against two ends of the heating element 62 respectively; the electrode columns 70 are subsequently connected to positive and negative electrodes of a power source, to realize power supply to the heating element 62.

The end cover 20 further defines an air inlet 21, for external air to enter the atomization chamber 80 when a user inhales through the smoking port A. According to the preferred design in the embodiments of the figures, the position where the air inlet 21 is defined is directly opposite to the heating element 62 on the air inlet surface 612.

When a user smokes, the e-liquid inside the e-liquid storage chamber 11 soaks into the porous element 61 from the e-liquid absorbing surface 611, and is heated and atomized into an aerosol which then escapes from the air inlet surface 612; while external air enters the porous element 61 from the air inlet surface 612, and enters the e-liquid storage chamber 11 after emerging from the e-liquid absorbing surface 611 in the form of bubbles, so as to keep balanced the pressure inside the e-liquid storage chamber 11.

In order to install and fix the atomization assembly 60, to seal the e-liquid storage chamber 11 and prevent the e-liquid inside the e-liquid storage chamber 11 leaking towards the end cover 20, FIG. 3 to FIG. 8 further show a structure diagram of a support element 50 in one embodiment. The support element 50 includes a sealing base 51 extending roughly along the cross section of the outer housing 10, wherein the sealing base 51 includes a through accommodation part 511 along the axial direction of the outer housing 10, and the porous element 61 is accommodated and held inside the accommodation part 511; meanwhile, based on the purpose of sealing the e-liquid storage chamber 11, a cross section of the sealing base 51 has a shape adapted to the outer housing 10, so as to tightly fit an inner wall of the outer housing 10 and form sealing.

Figure 6:
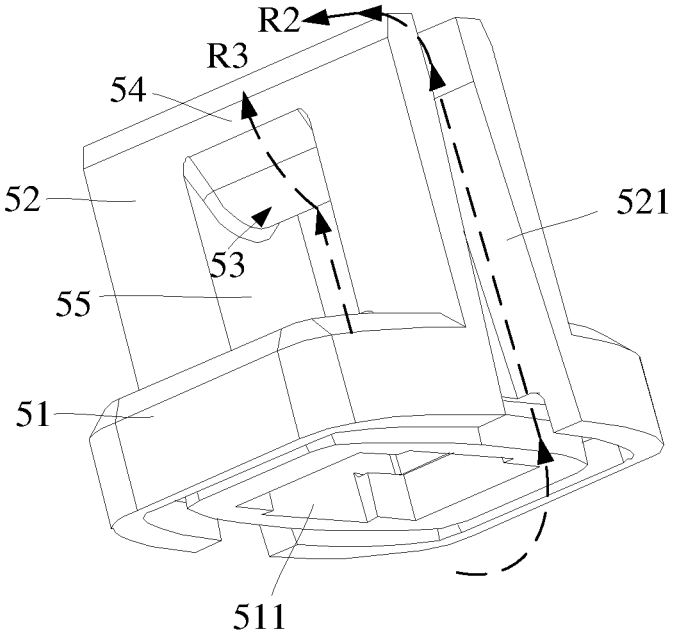
FIG. 6 is a structure diagram of a silicone base shown in FIG. 5 from another perspective.
Figure 7:
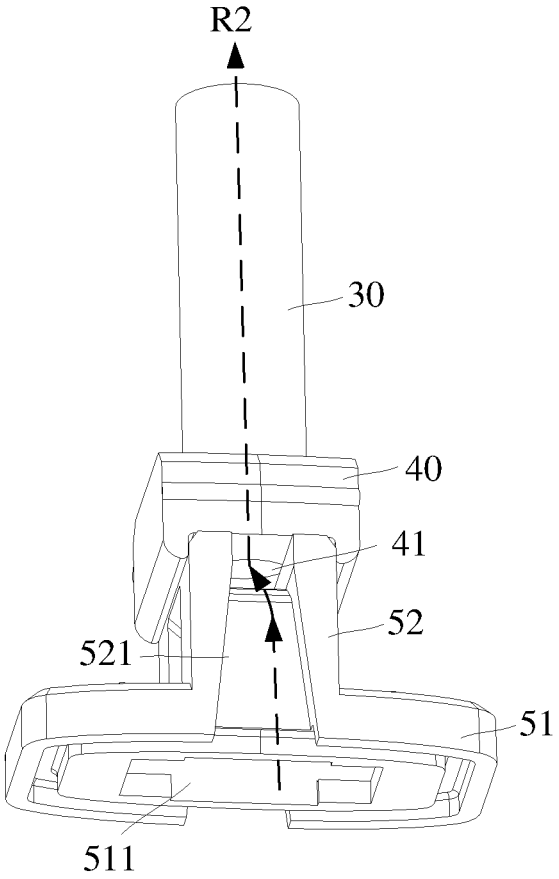
FIG. 7 is a structure diagram of a smoke pipe assembled with a silicone base shown in FIG. 3 from one perspective.
Figure 8:
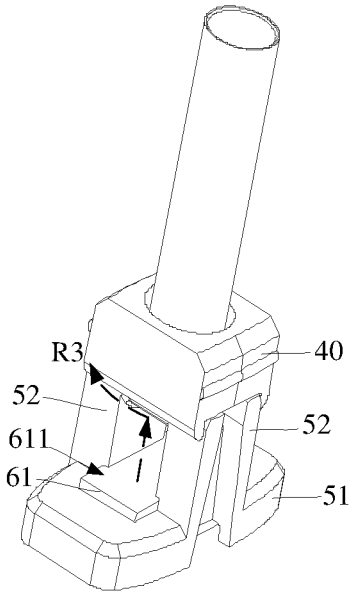
FIG. 8 is a structure diagram of a smoke pipe assembled with a silicone base shown in FIG. 7 from another perspective.

Meanwhile, the support element 50 further includes a bubble guiding portion 54 opposite to the e-liquid absorbing surface 611, and the bubble guiding portion 54 is connected to the silicone connection element 40 during assembly. As shown in FIG. 6 to FIG. 8, the bubble guiding portion 54 includes a bubble guiding surface 53 located above the e-liquid absorbing surface 611 and opposite to the e-liquid absorbing surface 611, wherein at least a portion of the bubble guiding surface 53 is obliquely arranged in a direction away from the e-liquid absorbing surface 611, from FIG. 5 and FIG. 6 it can be seen that the bubble guiding surface 53 is arranged presenting a curved cambered surface. When bubbles inside the porous element 61 emerge from the e-liquid absorbing surface 611 and reach the bubble guiding surface 53, they are guided upwards to enter the e-liquid storage chamber 11 more quickly and more smoothly, as indicated by an arrow R3 shown in FIG. 6 and FIG. 8, which can prevent the bubbles being accumulated near the e-liquid absorbing surface 611 to affect the absorption of e-liquid near the e-liquid absorbing surface 611. As shown in FIG. 6 and FIG. 8, the bubble guiding surface 53 is formed by a portion of a lower surface of the bubble guiding portion 54.

For the steadiness of the whole structure, the sealing base 51 is further provided with two support portions 52 that extend towards the bubble guiding portion 54, which are configured for connecting the sealing base 51 and the bubble guiding portion 54 as a whole, so as to keep the bubble guiding portion 54 steady.

As shown in FIG. 5 and FIG. 6, the bubble guiding surface 53 and the e-liquid absorbing surface 611 are spaced with certain distance, to form an area 55 opposite to the e-liquid absorbing surface 611 and supplying directly and quickly the e-liquid to the e-liquid absorbing surface 611; therefore, certain space is kept between the bubble guiding surface 53 and the e-liquid absorbing surface 611 to accommodate more e-liquid to supply to the e-liquid absorbing surface 611 in time, which can effectively avoid the occurrence that the bubble guiding surface 53 and the e-liquid absorbing surface 611 are adjacent to each other to make a too small space, as a result of which bubbles cannot emerge quickly and consequently the e-liquid cannot be supplied to the e-liquid absorbing surface 611 quickly and smoothly. Further, referring to FIG. 5, according to an optimal effect of e-liquid supply, a shortest distance D between the bubble guiding surface 52 and the e-liquid absorbing surface 611 along the axial direction of the outer housing 10 is greater than 3 mm, to guarantee that the size of the area 55 is enough to ensure the efficiency of supply of e-liquid.

Moreover, as shown in FIG. 6, the area 55 is located between the two support portions 52, openings on two sides of the two support portions 52 act as channels connecting the area 55 with the e-liquid storage chamber 11, so that the e-liquid flows into the area 55 from the e-liquid storage chamber 11 to realize smooth supply.

As shown in FIG. 3 and FIG. 5, in the block shaped porous element 61, an area inside the porous element 61 where most bubbles are generated while the e-liquid is atomized is the area corresponding to the heating element 62 along the axial direction; therefore, in one embodiment, a projection of the bubble guiding surface 53 along the axial direction can cover the portion of the e-liquid absorbing surface 611 opposite to the heating element 62.

The silicone connection element 40 roughly presents a block shape, of which the upper surface defines an insertion hole 41 for the smoke transmission pipe 30 to insert into and the lower surface is provided with a connection structure adapted to the bubble guiding portion 54, so that the silicone connection element 40 is fixed with the support element 50 through the adapted connection with the bubble guiding portion 54.

Further, in order for the aerosol escaping from the air inlet surface 612 to the atomization chamber 80 to be transmitted to the smoke transmission pipe 30 when a user smokes, the support element 50 further defines an air channel 521, one end of the air channel 521 is in airflow communication with the atomization chamber 80 while the other end is in airflow communication with an end part of the smoke transmission pipe 30 inserted into the insertion hole 41, so that the aerosol inside the atomization chamber 80 is output to the smoke transmission pipe 30 and a complete airflow channel is formed inside the atomizer when a user smokes, as indicated by an arrow R2 shown in FIG. 6 and FIG. 7.

Further, as shown in FIG. 7 and FIG. 8, the air channel 521 has a cross section decreased gradually towards the smoke transmission pipe 30, such that the inner wall narrows gradually, which is conducive to converging the aerosol to output.

Figure 9:
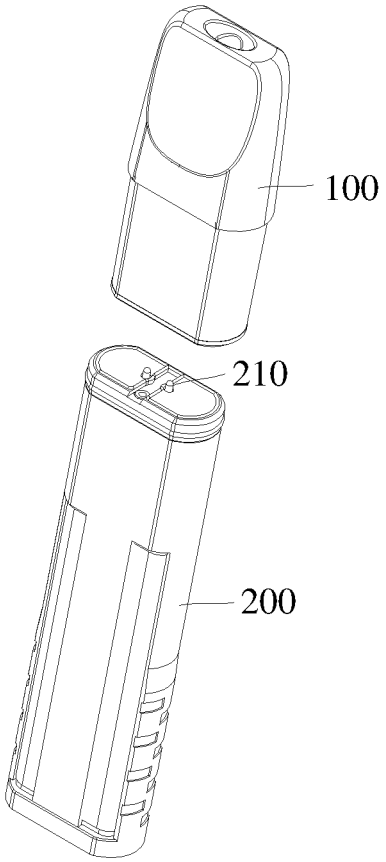
FIG. 9 is a structure diagram of an electronic cigarette according to one embodiment.

Referring to FIG. 9, an electronic cigarette is shown, including an atomization device 100 configured for atomizing an e-liquid, and a power device 200 configured for supplying power to the atomization device 100, wherein the atomization device 100 employs the atomizer described above, the power device 200 is provided with positive/negative electrode pogo pins 210 for electrical connection with the electrode columns of the atomization device 100 respectively, so as to realize power supply to the atomization device 100.

It is to be noted that the description and the accompanying drawings of the present disclosure just illustrate some preferred embodiments of the present disclosure, but are not limited to the embodiments described in the description; further, for the ordinary staff in the art, improvements or transformations can be made according to the above description, and these improvements and transformations are intended to be included in the scope of protection of claims appended hereinafter.

What is claimed is:

1. An atomizer, comprising an outer housing, wherein an airflow channel, an e-liquid storage chamber configured for storing an e-liquid and an atomization assembly configured for atomizing the e-liquid are arranged inside the outer housing; the atomization assembly comprises a porous element configured for absorbing the e-liquid from the e-liquid storage chamber, and a heating element configured for heating and atomizing the e-liquid absorbed by the porous element to generate an aerosol; the porous element comprises an e-liquid absorbing surface configured for absorbing the e-liquid from the e-liquid storage chamber, and an air inlet surface different from the e-liquid absorbing surface, wherein the air inlet surface is incorporated inside the airflow channel and is configured for allowing air to enter the porous element such that bubbles escape from the liquid absorbing surface to the liquid storage chamber; wherein a bubble guiding element opposite to the e-liquid absorbing surface is further arranged inside the outer housing and comprises a bubble guiding surface opposite to the e-liquid absorbing surface, at least a portion of the bubble guiding surface is obliquely arranged in a direction away from the e-liquid absorbing surface, such that the bubbles escaping from the e-liquid absorbing surface are guided towards the direction away from the e-liquid absorbing surface.

2. The atomizer according to claim 1, wherein the porous element partially extends to the e-liquid storage chamber such that the e-liquid absorbing surface is located inside the e-liquid storage chamber.

3. The atomizer according to claim 2, wherein at least a portion of a projection of the bubble guiding surface along the axial direction of the outer housing covers the e-liquid absorbing surface of the heating element.

4. The atomizer according to claim 1, wherein the bubble guiding surface and the e-liquid absorbing surface are spaced with certain distance, to form an area opposite to the e-liquid absorbing surface and supplying the e-liquid to the e-liquid absorbing surface.

5. The atomizer according to claim 4, wherein a shortest distance between the bubble guiding surface and the e-liquid absorbing surface along the axial direction of the outer housing is greater than 3 mm.

6. The atomizer according to claim 4, wherein a sealing base configured for sealing the e-liquid storage chamber is arranged inside the outer housing, and the sealing base is provided with a support portion that extends towards the bubble guiding element, so as to support the bubble guiding element.

7. The atomizer according to claim 6, wherein the sealing base is arranged extending along a cross section of the outer housing;

the support portion comprises a first support portion and a second support portion that are arranged on two sides of the sealing base along the cross section of the outer housing; and between the first support portion and the second support portion is formed a channel for the e-liquid to flow to the area from the e-liquid storage chamber.

8. The atomizer according to claim 6, wherein at least a portion of the airflow channel runs through the support portion along the axial direction of the outer housing.

9. The atomizer according to claim 8, wherein at least a portion of the airflow channel has a cross-section area decreased gradually along the flow direction of airflow.

10. An electronic cigarette, comprising an atomization device configured for atomizing an e-liquid to generate an aerosol, and a power device configured for supplying power to the atomization device, wherein the atomization device comprises an atomizer, comprising an outer housing, wherein an airflow channel, an e-liquid storage chamber configured for storing an e-liquid and an atomization assembly configured for atomizing the e-liquid are arranged inside the outer housing; the atomization assembly comprises a porous element configured for absorbing the e-liquid from the e-liquid storage chamber, and a heating element configured for heating and atomizing the e-liquid absorbed by the porous element to generate an aerosol; the porous element comprises an e-liquid absorbing surface configured for absorbing the e-liquid from the e-liquid storage chamber, and an air inlet surface different from the e-liquid absorbing surface, wherein the air inlet surface is incorporated inside the airflow channel and is configured for allowing air to enter the porous element such that bubbles escape from the liquid absorbing surface to the liquid storage chamber: wherein a bubble guiding element opposite to the e-liquid absorbing surface is further arranged inside the outer housing and comprises a bubble guiding surface opposite to the e-liquid absorbing surface, at least a portion of the bubble guiding surface is obliquely arranged in a direction away from the e-liquid absorbing surface, such that the bubbles escaping from the e-liquid absorbing surface are guided towards the direction away from the e-liquid absorbing surface.

11. The atomizer according to claim 2, wherein the bubble guiding surface and the e-liquid absorbing surface are spaced with certain distance, to form an area opposite to the e-liquid absorbing surface and supplying the e-liquid to the e-liquid absorbing surface.

12. The atomizer according to claim 11, wherein a shortest distance between the bubble guiding surface and the e-liquid absorbing surface along the axial direction of the outer housing is greater than 3 mm.

13. The atomizer according to claim 11, wherein a sealing base configured for sealing the e-liquid storage chamber is arranged inside the outer housing, and the sealing base is provided with a support portion that extends towards the bubble guiding element, so as to support the bubble guiding element.

14. The atomizer according to claim 13, wherein the sealing base is arranged extending along a cross section of the outer housing;

the support portion comprises a first support portion and a second support portion that are arranged on two sides of the sealing base along the cross section of the outer housing; and between the first support portion and the second support portion is formed a channel for the e-liquid to flow to the area from the e-liquid storage chamber.

15. The atomizer according to claim 13, wherein at least a portion of the airflow channel runs through the support portion along the axial direction of the outer housing.

16. The atomizer according to claim 15, wherein at least a portion of the airflow channel has a cross-section area decreased gradually along the flow direction of airflow.

17. The atomizer according to claim 3, wherein the bubble guiding surface and the e-liquid absorbing surface are spaced with certain distance, to form an area opposite to the e-liquid absorbing surface and supplying the e-liquid to the e-liquid absorbing surface.

18. The electronic cigarette according to claim 10, wherein the porous element partially extends to the e-liquid storage chamber such that the e-liquid absorbing surface is located inside the e-liquid storage chamber.

19. The electronic cigarette according to claim 10, wherein at least a portion of a projection of the bubble guiding surface along the axial direction of the outer housing covers the e-liquid absorbing surface of the heating element.

20. The electronic cigarette according to claim 10, wherein the bubble guiding surface and the e-liquid absorbing surface are spaced with certain distance, to form an area opposite to the e-liquid absorbing surface and supplying the e-liquid to the e-liquid absorbing surface.

* * * * *